United States Patent [19]

Murao et al.

[11] Patent Number: 4,811,748

[45] Date of Patent: Mar. 14, 1989

[54] METHOD AND APPARATUS FOR CONTINUOUSLY APPLYING SURFACE TREATMENT ONTO AN ARTICLE BEING FED ALONG A PASS LINE

[75] Inventors: Masatsugu Murao; Kazuhiko Murao; Tsuyoshi Mochizuki, all of Osaka, Japan

[73] Assignee: Naniwa Seitei Kabushiki Kaisha, Osaka, Japan

[21] Appl. No.: 848,132

[22] Filed: Apr. 4, 1986

[51] Int. Cl.[4] ..... B08B 3/04

[52] U.S. Cl. ..... 134/122 R; 134/198; 134/199

[58] Field of Search ..... 134/64 R, 64 P, 122 R, 134/122 P, 198, 199; 68/5 D, 5 E

[56] References Cited

U.S. PATENT DOCUMENTS

| | | | |
|---|---|---|---|
| 2,307,694 | 1/1943 | Malke | 134/122 R |
| 2,509,668 | 5/1950 | Berggren | 134/64 R |
| 3,204,037 | 3/1966 | Bittle et al. | 68/5 E |
| 3,623,532 | 11/1971 | Cofer | 134/64 R |
| 3,927,540 | 12/1925 | Tanaka et al. | 68/5 E |
| 4,270,317 | 6/1981 | Kurie | 134/64 R |

*Primary Examiner*—Harvey C. Hornsby
*Assistant Examiner*—Frankie L. Stinson
*Attorney, Agent, or Firm*—Birch, Stewart, Kolasch & Birch

[57] ABSTRACT

A continuous article has its surface treated twice by first and second jets of fluids as passing though a tunnel provided on a pass line. A fluid flow is supplied through each of first and second introducing ports into the tunnel where it is converted into each of the first and second jets of fluids, one rushing over the article in the same direction as the article and the other rushing over the same in the opposite direction thereto for effecting surface treatments respectively by the first and second jets of fluid. Each of the first and second jets causes a negative pressure to be developed at each inlet and outlet outlet of the tunnel through which the article enters and exits the tunnel. The negative pressure in turn draws in the ambient air through the inlet and the outlet over the article to thereby provide an air seal at each inlet and outlet, preventing the fluids introduced in the tunnel from escaping outwardly thereof. The fluids after rushing over the article advance into an expansion chamber formed within the tunnel midway between the inlet and the outlet and is recovered through a discharge port of the expansion chamber. Accordingly, the surface treatment of the article can be performed in a closed system so as not to worsen the working environment.

5 Claims, 2 Drawing Sheets

METHOD AND APPARATUS FOR CONTINUOUSLY APPLYING SURFACE TREATMENT ONTO AN ARTICLE BEING FED ALONG A PASS LINE

BACKGROUND OF THE INVENTION

1. Field of the Invention

The present invention is directed to a method and apparatus for continuously applying surface treatment onto an article such as a wire, rod, sheet or the like continuous material being fed along a pass line. More particularly, the invention is directed to cleaning off the water and scales remaining on an intermediate or final products of the above articles or coating a lubricant on the wire article prior to proceeding into a wire drawing process.

2. Description of the Prior Art

Such continuous articles are generally required to be subjected to a variety of surface treatments depending upon their applications. Included in these surface treatments are washing such as acid wash, alkaline wash, water wash, or wash with a detergent or a solution of trichloroethylene required prior to a plating operation or machining operation of forming the article into precision components which must be free from any dust or foreign matter, lubricant coating required prior to a wire drawing operation, coating the article in the form of a finished product with a rust-preventive oil, coating the article with paint powder for powder paining operation, and drying after the washing or before packing the final products. In all the cases, the entire surface of the article should h=treated without leaving any untreated portion irrespective of the cross sectional configuration of the article.

In the above wire drawing process, for example, there have been commonly employed a dry process in which the wire is coated with an emulsified lime and is then dried to form a dry coat of lime as a lubricant on the wire prior to being pulled through a draw plate, or a wet process in which the wire is pulled through a die of the draw plate while spraying a lubricant such as mineral oil, and a half-wet process in which the wire is finished with a wet coat of lime and is pulled through the draw plate before the coating is dried. The above processes, however, pose individual problems. That is, with the above dry process there is required a bothering and troublesome priming operation of firstly coating the emulsified lime and then drying the same, which renders this process rather inconvenient in addition to the fact that lime particles will be scattered around while the wire is pulled through the die to worsen a working environment.

Also with the above wet process, there should be additionally required a reservoir for recovering or circulating the lubricant used to be sprayed onto the drawing plate, limiting the process line solely to this process and not allowing the line to be applied to the other process. This also renders this process rather inconvenient in addition to the fact that the lubricant will be likewise scattered around to worsen the working environment.

Further with the half-wet process, the die suffers from considerable wearing while enabling a mirror-finished surface on the wire drawn, making the process rather inconvenient for practical use. As described, the individual processes involve their own limitations along with their advantages and require specific process lines which are not applicable to the other processes.

To this end, wire manufacturers are usually obliged to equip more than one of the process lines designed to the particular processes so as to be capable of performing the particular processes as required, which adds undue cost and is therefore disadvantageous from an economical view point.

Further, the wires employed in the drawing processes are not limited to have a circular cross section and may have other particular cross sections such as elliptical or polygonal cross sections or the cross sections with grooves or reccesses in its periphery. Such wires of differing cross section have been difficult to be successfully drawn by the use of one of the above processes. This also forces the wire manufactures to be equipped with more than one of the above process lines depending upon the differing cross sections of the wires being treated or equipped with other specially arranged lines suitable for particular cross section of the wires.

Additionally, since the above processes are normally performed in an open system the lubricants will spread around during the processing to thereby worsen the working environment.

SUMMARY OF THE INVENTION

It is the overall object of the present invention to provide a method and an apparatus capable of eliminating the above problems and effectively treating the article's surface, while enabling the drying of the article simultaneously with a desired surface treatment.

A second object of the present invention is to enable two different surface treatments to be continuously applied onto the article as passing the article on a single process line or through a single apparatus, yet enabling the drying of the article simultaneously with the two different kinds of surface treatments.

A third object of the present invention is to apply a smooth and uniform coating of fluid such as rust-preventive oil, or powder paint continuously onto the article.

A fourth object of the present invention is to allow the surface treatment to be performed in a closed system for preventing the fluid applied to the article from scattering around, enabling the surface treatment in a clean environment.

A fifth object of the present invention is to provide an apparatus which is capable of being utilized as a general-purpose apparatus to be applied to a variety of surface treatments.

A method of continuously applying surface treatment on an article being fed along a pass line in accordance with the present invention comprises the steps of providing a tunnel having its longitudinal axis aligned with the pass line and formed with an inlet and an outlet at the longitudinal ends thereof, said tunnel having a discharge port intermediate its longitudinal ends and having first and second fluid introducing ports at locations respectively inwardly of the inlet and outlet; continuously feeding the article through the tunnel as passing it from the inlet toward the outlet thereof; supplying a fluid flow from the first introducing port into the tunnel and producing within the tunnel a first jet of the fluid which rushes over the passing article in the same direction as the article in order to treat the surface of the article by that fluid and at the same time which develops a negative pressure upstream of the first jet in order to draw in the ambient air through the inlet over the article for providing an air seal thereabout whereby the fluid is prevented from aping through the inlet outwardly of the tunnel; supplying a fluid flow from the second introducing port into the tunnel and producing within the tunnel a second jet of the fluid which rushes over the passing article in the opposite direction thereto in order to treat the surface of the article by that fluid and at the same time which develops a negative pressure upstream of the second jets in order to draw in the ambient air through the outlet over the article for providing an air seal thereabout whereby the fluid is prevented from escaping through the outlet outwardly of the tunnel; and recovering the fluid from the tunnel through the discharge port.

With this method, the article while passing through the tunnel can have its surface exposed to the first and second jets of the fluid one rushing over the article in the same direction as the latter and the other in the opposite direction, increasing the chances of contact between the article's surface and the fluid to thereby present an effective surface treatment. For example, when the fluids of the same kind are respectively supplied to provide the first and second jets for the same surface treatment, the combined effect of the two jets acting in the opposite direction can successfully treat the entire surface of the article even if there be such surface irregularity that the entire surface cannot be treated thoroughly by the jet acting on the article only in one direction. In this connection, the method of the present invention is particularly advantageous for surface treatment of the article of a complicated surface configuration or cross section. When the fluids of the different kinds are introduced, the different kinds of the surface treatments can be obtained while passing the article through the tunnel or along a single pass line, enabling the article to be subjected to a desired combination of different surface treatments continuously and effectively within the single tunnel.

Also with the above method, each of the first and second jets of the fluid additionally develops a negative pressure upstream thereof which causes the ambient air to be drawn in through each inlet and outlet to thereby provide the air seal at each inlet and outlet, thus preventing the inside fluid from escaping outwardly through the inlet or outlet. Accordingly, the surface treatment by the jets of the fluids can be performed in a closed system without scattering the fluid outwardly tunnel and therefore without worsening the working environment. The ambient air caused by the negative pressure also rushes over the article passing through each inlet and outlet in the form of an air blast which can be utilized to dry and clean the surface of the article before and after subjected to one or two kinds of surface treatments by the first and second jets of the fluids. In this sense, the first and second jets, in addition to provide the surface treatments within the tunnel, can be utilized to provide the air seals of the inlet and the outlet and further to enable the prior and post surface treatment of the article.

Preferably, the first and second jets are expanded the article within the tunnel after rushing over the article to produce rather vortex flows about the article midway between the zones where the first and second jets are applied to the article's surface, respectively. Such expanded vortex flows originating from the first and second jets are expected to be smoothly directed to a discharge port at one peripheral portion of the tunnel to be thereby effectively discharged therethrough. In addition, said expanded vortex flows serve to effectively separate the above zones to each other so as to mitigate the interference between the first and second jets, allowing the first and second jets to act on the article independently and effectively, while continuously applying the first and second jets. Further, the formation of the vortex flows is particularly advantageous when the method is utilized for removing the water off the article's surface since the vortex flows swirling about the article can further enhance the vaporization of the water from the article's surface.

An apparatus for applying surface treatment on an article being fed along a pass line in accordance with the present invention comprises a tunnel adapted to be located on a portion of the pass line with its longitudinal axis aligned therewith, said tunnel being provided at one longitudinal end with an inlet through which the article to be treated enters the tunnel and at the other longitudinal end with an outlet through which the article exits the tunnel. The tunnel includes an expansion chamber midway between the inlet and the outlet. First and second fluid introducing ports are formed each between the expansion chamber and each of the inlet and the outlet for introducing a fluid flow in the the tunnel therethrough. Intercommunicating between the expansion chamber and the first fluid introducing port and between the expansion chamber and the second fluid introducing port are first and second constricted passageways respectively extending along the pass line for receiving therethrough said article to be treated. A first throat is formed between the first fluid introducing port and the end of the constricted passageway remote from the expansion chamber so as to produce a first jet of the fluid supplied from the first fluid introducing port and force it to blow into the passageway where it rushes over the article in the same direction as the article for treating the surface thereof, said first jet developing a negative pressure upstream thereof so as to draw in the ambient air through the inlet over the article for providing an air seal around the article within the inlet whereby preventing the fluid from escaping outwardly through the inlet. A second throat is likewise formed between the second fluid introducing port and the end of the constricted passageway remote from the expansion chamber so as to produce a second jet of the fluid supplied from the second fluid introducing port and force it to blow into the passageway where it rushes over the article in the opposite direction to the article passing in the passageway for treating the surface thereof, said second jet developing a negative pressure upstream thereof so as to draw in the ambient air through the outlet over the article for providing an air seal around the article within the outlet whereby preventing the fluid from escaping outwardly through the outlet. Said expansion chamber is formed with a discharge port for recovering the first and second fluid flows which has rushed over the article.

With this arrangement, the article can be treated twice by the first and second jets of fluids while passing through the tunnel such that the article can enjoy improved surface treatment and as well can have different kinds of surface treatments within the tunnel by introducing the fluids of different kinds through the first and second fluid introducing ports. Each of the inlet and the outlet is air sealed by the ambient air being drawn therethrough over the article due to the negative pressured developed behind the first and second jets. Accordingly, the surface treatments due to the first and second jets can be performed in a closed system where the fluids can be prevented from escaping outwardly of the tunnel, ensuring a clean working environment.

In a preferred embodiment, the expansion chamber is formed in its interior wall with spiral grooves along which the fluids emerging from the first and second passageways and expanded in the expansion chamber are guided to produce vortex flows about the article. These vortex flows formed between the first and second passageway can serves as a buffer to mitigate the interference between the first and second jets acting toward the expansion chamber so as to enable the surface treatments at the respective passageways without causing the interference. Additionally, said vortex flows merge into a composite vortex flow around the expansion chamber to be thereby successfully directed to the discharge port at one peripheral portion of the expansion chamber so as to be effectively discharged therethrough.

The first and second constricted passageways may be formed with spiral grooves respectively in the inner surfaces thereof. Thus, the first and second jets can be each given a swirling motion about the article to be treated for effectively applying the fluid thereon. Such swirling motion given to the first and second jets ensures the contact of the fluid over the entire circumference of the article, resulting in an uniform surface treatment around the article and additionally facilitating the formation of the vortex flows in the expansion chamber.

Also in the preferred embodiment, each of the first and second throats is defined between opposed conical surfaces at least one of which is formed with a spiral groove therein. This is advantageous for effectively producing the first and second jets as initiating the swirling motion thereof.

Each of the first and second constricted passageways has an parabolically shaped opening at its one end portion adjacent the expansion chamber. Said parabolic opening having an internal diameter larger toward the expansion chamber for enhancing the expansion effect of the fluids in the expansion chamber.

In another preferred embodiment, the internal diameter of said expansion chamber is larger toward the middle than at either longitudinal end for effectively producing the vortex flows within the expansion chamber.

These and other objects of the present invention will be more apparent from the following description of the embodiments when taken in conjunction with the accompanying drawings.

DETAILED DESCRIPTION OF THE PREFERRED EMBODIMENTS

Figure 1:
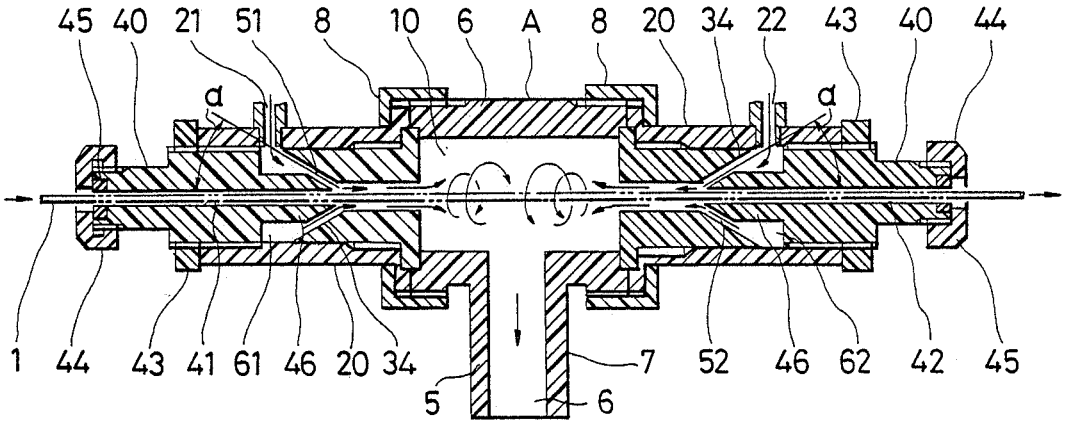
FIG. 1 is a vertical section of the apparatus in accordance with a first embodiment of the present invention.

Referring now to FIG. 1, there is shown an apparatus A for applying surface treatment onto an continuous article 1 to be fed along a straight pass line in accordance with a first embodiment of the present invention. The apparatus A is adapted to be disposed on the pass line and comprises an envelop 2 defining therein a tunnel through the length of which the continuous article 1 such as a wire, rod or the like passes so as to be subjected to a desired one or two kinds of surface treatments therein. The tunnel or envelop 2 has at its longitudinal ends an axially aligned inlet 3 and an outlet 4 through which the article 1 enters and exits the tunnel 2.

The envelop 2 includes a T-shaped tube 5 with a main tubular portion 6 of relatively large internal diameter and a depending tubular portion 7 extending in a perpendicular relation thereto and having a smaller internal diameter, said main tubular portion 6 being located midway between the inlet 3 and the outlet 4 and defining an expansion chamber 10 therein, and said depending tubular portion 7 defining a discharge port 9. Axially connected by means of a lock nut 8 to either side of the expansion chamber 10 is a sleeve 20 for receiving therein inner and outer hollow cylinders 30 and 40 which are axially aligned to form an axially elongate bore through which the article 1 is passed. The inner cylinder 30 is retained in a fixed position within the sleeve 20 with its end flange 33 held between the ends of the main tubular portion 6 of the T-shaped tube 5 and the sleeve 20 and with its outer wall in sealed contact with the inner wall of the sleeve 20. The outer cylinder 40 is externally threaded for engagement with an adjusting nut 43 which abuts against the end of the sleeve 20 for adjusting the axial displacement of the outer cylinder 40 with respect to the fixed inner cylinder 30. An end lock nut 44 is threaded on the extreme end of the outer cylinder 40 to hold a nozzle ring 45 coaxially seated in a recessed portion in the end face of the outer cylinder 40, said nozzle ring 45 being made of an abrasion-resistive material such as ceramics, hard metal, hard plastics and defining each one of said inlet 3 and the outlet 4. Said inner cylinders 30 on the opposite sides of the expansion chamber 10 define therethrough first and second constricted passageways 31 and 32 respectively of considerably smaller internal diameter than the expansion chamber 10, while said outer cylinders 40 define therethrough first and second slots 41 and 42 respectively of relatively small internal diameter than the adjacent passageways 31 and 32, said slots 41 and 42 being in open communication with said first and second passageways 31 and 32 to form the axial bores respectively leading from the inlet 3 to the expansion chamber 10 and leading from the latter to the outlet 4. The article 1 moves continuously through these axial bores as it enters and exits the tunnel 2.

Each of the inner cylinders 30 is formed at the end remote from the expansion chamber 10 with a conically recessed section 34 the bottom of which opens to each of the first and second passageways 31 and 32. Projecting inwardly from each of the outer cylinders 40 is a nose 46 which has its end tapered into a conical shape and extends into the conical section 34 of the corresponding inner cylinder 30 so as to define therebetween each one of first and second annular throats 51 and 52. The line passing through each of throats 51 and 52 is inclined with respect to the common axis of the passageways 31 and 32 at an angle $\alpha$ of between 15 and 60°. The gap distance of each throat can be adjusted by moving axially the outer cylinder 40 to and from the adjacent fixed inner cylinder 30 and is fixed to a desired value by locking the adjusting nut 43. The noses 46 leave therearound within the sleeves 20 first and second cavities 61 and 62 each receiving temporarily a fluid flow to be supplied from the outside through each of the first and second fluid introducing ports 21 and 22 provided in the respective sleeves 20 intermediated the ends.

The fluid supplied at an increased pressure through the first fluid introducing port 21 is firstly delivered to the first cavity 61 and is then driven to flow through the throat 51 where it is further compressed to provide a first jet of the fluid which is forced into the first constricted passageway 31 to rush over the article 1 passing therethrough, applying a desired surface treatment on the article 1 by that fluid. After rushing over the article 1 the first jet of the fluid enters the expansion chamber 10 where it is expanded about the article 1 and is discharged or recovered through the discharge port 9. Likewise, the fluid supplied at an increased pressure through the second fluid introducing port 22 is forced to rush over the article 1 in the second passageway 32 so as to apply the like or another surface treatment thereto by the fluid employed. It is to be noted that the first jet of the fluid acts on the article 1 in the same direction as the article 1 while the second jet of the fluid in the opposite direction thereto.

As a result of producing the first and second jets, a negative pressure is developed upstream thereof, or, at the inlet 3 and the outlet 4, which negative pressure draws in the ambient air through each of the inlet 3 and the outlet 4 over the article 1 so as to provide thereat an air seal against the leakage of the fluid, preventing the fluid from escaping outwardly of the tunnel 2. Consequently, the fluid employed for the surface treatment purpose can be recovered without causing any scattering outside of the apparatus A so as to present a closed surface treatment system, ensuring a clean working environment. The ambient air thus drawn in will rush over the article 1 in the form of an air blast which is additionally utilized to blow off any scales on the article 1 or to dry the article's surface before and after the surface treatments by the first and second jets of the fluids.

Figure 2:
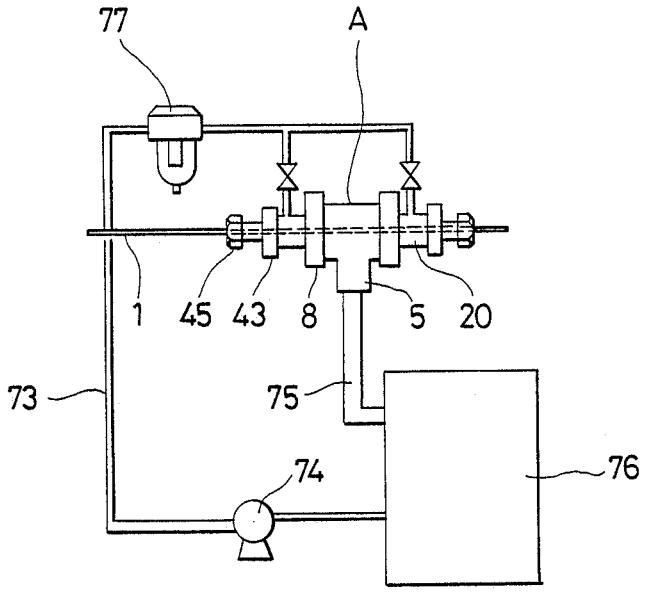
FIG. 2 is a schematic view showing a process line including the above apparatus utilized for drying and cleaning the article passing along a pass line.

FIG. 2 shows one typical arrangement utilizing the above apparatus A for cleaning or drying the surface of the article 1 in the form of a wire or rod material after washing it with water, detergent, or the like liquid. In this application, compressed air is supplied both through the first and second fluid introducing ports 21 and 22 to clean and dry the article's surface by the resulting first and second jets of air. For this purpose, the apparatus A has the first and second fluid introducing ports 21 and 22 connected through respective flow control valves 71 and 72 to a supply line 73 with an air compressor 74, while having the discharge port 9 connected through a return line 75 to a reservoir 76 such as a cyclone which is in turn connected to the supply line 73 behind the air compressor 74 to present a closed system of circulating the air between the apparatus A and the reservoir 76. A filter 77 is provided on the supply line 73 for removing the water content or any other impurities carried on the compressed air being fed to the first and second fluid introducing ports 21 and 22.

The compressed air introduced in the apparatus A is further forced to produce the first and second air jets as passing through the throats 51 and 52. The first and second air jets rush over the article 1 while the latter advances respectively through the first and second constricted passageways 31 and 32, drying or blowing off any residual water, scale or other foreign matter remaining stuck on the article's surface. As described in the above the first and second air jets are responsible for additionally drawing the ambient air through the inlet 3 and the outlet 4 over the article so as to provide the air seal thereat, preventing the compressed air from escaping therethrough. The ambient air drawn in by the negative pressure developed behind the jets also rushes over the article 1 at the inlet 3 and the outlet 4 so as to give an extra surface drying and cleaning effect thereat, increasing the cleaning and drying effect of the article 1. Since the first and second air jets acting on the article 1 in opposite directions, the article can be effectively removed of the water or the like foreign material which would be difficult to be removed if applying an air jet only in one direction. In this sense, the apparatus is most advantageous for cleaning and drying the article 1 having surface irregularity or complicate cross section.

Each of the first and second air jets after rushing over the article 1 enter the expansion chamber 10 where they expand rapidly to flow along the inner surface of the expansion chamber 10 at a reduced velocity so as to be converted into a rather vortex flow about the article 1, which vortex flow will expedite the evaporation of the water from the article's surface to further improve the drying effect. These vortex air flows carrying the water are to be discharged through the discharge port 9 to the reservoir 76 where the water content is removed from the air to reproduce a dry air, which is again fed by the air compressor 74 to the first and second fluid introducing ports 21 and 22. In this way the air circulates the apparatus A and the reservoir 76 to perform the drying and cleaning treatment in a closed system. In this application, the air is forced into the apparatus A by means of the air compressor provided on the supply line 73, however, the same effect can be obtained by providing an air compressor or the like on the return line 75 instead or by adding it on the return line 75.

Another use of the apparatus A is for degreasing the article 1 by the use of detergent, for example, trichloroethylene. In this application, trichloroethylene is supplied at an increased pressure through the first and second fluid introducing ports 21 and 22 to produce the corresponding first and second jets, which rush over the article 1, brushing the surface of the article 1 to remove even monomolecular layer of the grease and any other scales therefrom, effectuating thorough cleaning of the article's surface. Likewise in the previous application, when the article having complicatedly recessed surface is to be treated, the jets of trichloroethylene can spout deep into the recesses to realize an effective decreasing or cleaning treatment. It is noted at this point that the second jet of trichloroethylene rushes over the article 1 at a higher velocity than the first jet rushing in the same direction as the article 1 and therefore gives more effective treatment to the article's surface. Also, the article 1 at the time of passing though the outlet 4 is subjected to the flow of ambient air drawn over the article 1 due to the negative pressure developed in the apparatus A, so that it can have its surface dried effectively at this moment, requiring no additional dying process and making it ready for a subsequent process. When the article to be treated is of rather simple configuration, it is equally possible to supply trichloroethylene through the first fluid introducing port 21 and supply the compressed air through the second fluid introducing port 22. In this instance, more effective drying can be obtained by the resulting second jet of the air rushing over the article after being treated by the first jet of trichloroethylene.

Figure 3:
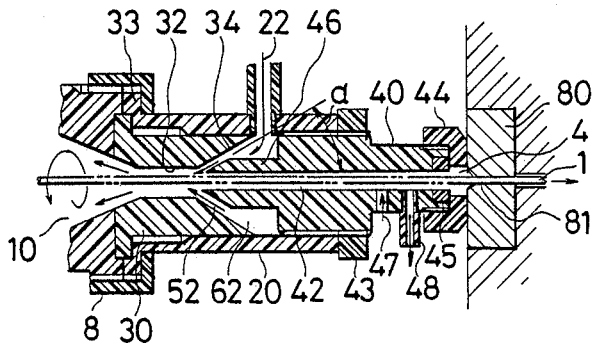
FIG. 3 is a vertical section of the outlet end portion of the apparatus utilized to apply a lubricant on the wire article prior to drawing the wire.

Other application of the apparatus A of the present invention is for applying a coat of a suitable lubricant onto the surface of the wire article prior to proceeding it to a wire drawing process. That is, the apparatus A is used for drawing the wire in the wet process generally utilizing lubricants such as water, soapy water, mineral oils. In this application, the apparatus A is disposed behind a draw plate 80 with a die 81 in coaxial relation thereto, as shown in FIG. 3. A suitable lubricant selected depending upon the kinds of the article to be treated is supplied at an increased pressure to the first and second fluid introducing ports 21 and 22 (though only one of which is seen in FIG. 3). The lubricant is then forced within the apparatus A to produce first and second jets which wash the article's surface and simultaneously leaving a thin coat of the lubricant thereon. The article 1 thus finished with the coat of lubricant is to proceed through the draw plate 80 into a reduced diameter. The lubricant discharged from the discharge port 9 is recovered into a reservoir (not seen) and filtered for removal of any impurities and is then reused to be again supplied to the apparatus A, forming a closed lubricant circulation system. The lubricant may be supplied in the form of being carried on a compressed air. Alternatively, the lubricant may be supplied through one of the first and second fluid introducing port 21 and 22 while supplying a compressed air through the other port in such a way that the article 1 is continuously subjected to the jet of the lubricant and to the air jet, and vice versa.

When the article 1 is required to be finished with a wet coat of lime as a lubricant prior to the drawing process, the apparatus A of the invention can be also successfully incorporated in the process line, in which case water and minute powder of lime are separately supplied to the first and second fluid introducing ports 21 and 22, respectively for producing the first jet of water and the second jet of the lime. Whereby, the second jet of lime is sprayed over the article 1 immediately after the article 1 is moistened by the first jet of water so as to form the desired wet coat of lime on the article. Further, the water solution of lime may be supplied to produce the first and second jets of that solution for applying the corresponding lubricant coat onto the article's surface as necessary for another drawing process. When the draw plate 80 is disposed in abutment with the outlet end of the apparatus A, as shown in FIG. 3, the apparatus A is preferred to include at portions adjacent to the outlet 4 an air vent 47 and a drain port 48. The air vent 47 serves to draw in the ambient air instead of the outlet 4 in the previous application for providing the air seal, and the drain port 48 serves to drain excess amount of lubricant left behind the die 81 of the draw plate 80, the drain port 48 being preferably connected to the reservoir for the purpose of reusing the lubricant.

Besides the above, the apparatus of the present invention can be successfully utilized for other surface treatment applications such as continuously applying a coat of rust-preventive oil, spraying a liquid containing abrasives, or spraying powder paint on the article's surface. In these applications, it is also possible to supply different kinds of fluids, i.e., the compressed air and a suitable liquid individually to the first and second fluid introducing ports 21 and 22 for continuously subjecting the article to the resulting first and second jets of different kinds of fluids, in the like manner as described hereinbefore.

Figure 4:
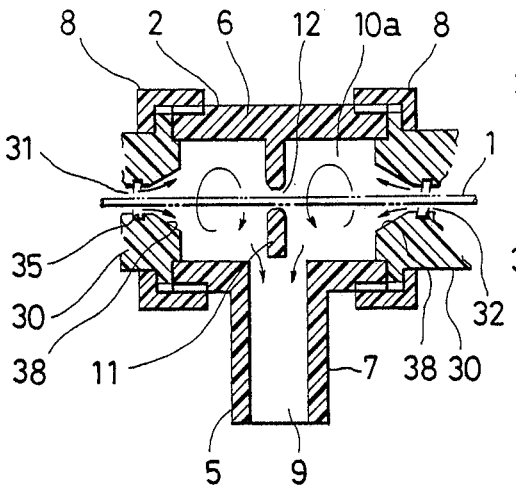
FIG. 4 is a vertical section of a first modification of the apparatus showing the central portion thereof.

FIG. 4 shows a first modification of the above embodiment which is similar in construction to the embodiment except that a partition wall 11 with a center hole 12 is formed in the expansion chamber 10*a* to divide it into two sections which are communicated with each other through the center hole 12 and open to the discharge port 9. With this partition 11, the vortex flows resulting from the first and second jets can be swirled substantially within the independent sections so as to be smoothly directed to the discharge port 9 without interfering with each other, thus increasing the discharging efficiency. Also in this modification, each of the first and second constricted passageways 31*a* and 32*a* has on inner surface with a spiral groove 35 by which the jets can swirl about the article 1 so as to rush over the entire circumference of the article 1, giving a uniform surface treatment to the article, particularly the article of rounded cross section. The spiral groove 35 may be formed partially or along the entire length of the fins and second constricted passageways 31 and 32. The spiral groove 35 can also serve by itself or in combination with a parabolically shaped opening 38 formed at the end of the corresponding passageway 31 adjacent the expansion chamber 10 to facilitate the formation of the vortex flow within the expansion chamber 10. As a matter of course, the parabolically shaped opening 38 alone could facilitate the formation of the vortex flow.

Figure 5:
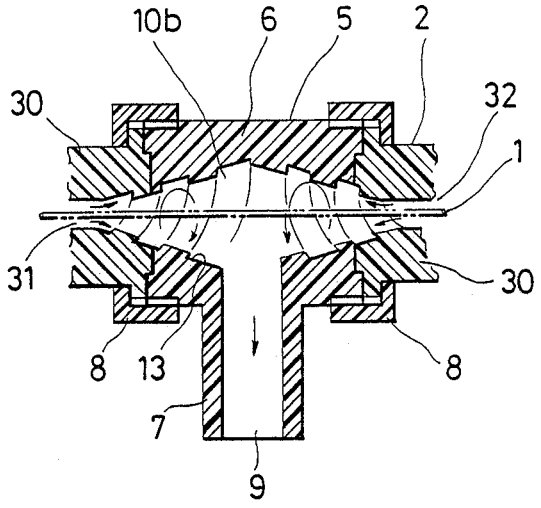
FIG. 5 is a vertical section of a second modification of the apparatus showing the center portion thereof.

A second modification of the above embodiment is shown in FIG. 5 which is similar in construction to the embodiment except that the expansion chamber 10*b* is configured to have an internal diameter larger toward the middle than at either end. The inner wall the expansion chamber 10*b* is formed with a spiral groove 13 the ends of which terminate in the end portions of the first and second passageways 31 and 32. This also serves to facilitate the formation of the vortex flows in the expansion chamber 10*b*.

Figure 6:
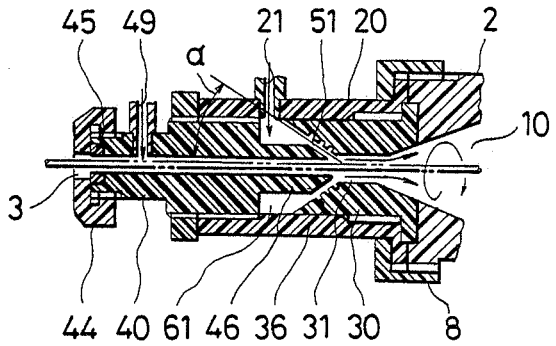
FIG. 6 is a vertical section of a third modification of the apparatus showing the inlet end portion thereof.

A third modification of the present invention is shown in FIG. 6 which includes a supply vent 49 formed adjacent the inlet 3 to extend radially into the first slot 41. The supply vent 49 is for additionally supplying a desired surface treating agent to the surface of the article 1 by better utilization of the suction force developed by the first jet of the fluid supplied through the first fluid introducing port 21. That is, the additional surface treating agent is drawn together with the ambient air respectively through the supply vent 49 and the inlet 3 onto the article passing through the first slot 41 to be thereby sprayed thereon. In this modification, a spiral groove 36 is formed in the wall of the conically recessed section 34 of each inner cylinder 30 to impart the swirling motion to the first and second jets produced at the corresponding throat 51, readily swirling the first and second jets in the first and second constricted passageways 31 and 32 for providing uniform surface treatment around the entire periphery of the article 1. Such spiral groove 36 may be alternatively formed in the corresponding nose 46. The other constructions are similar to the above embodiment.

Although the present invention disclosed in the attached drawings the symmetrical construction of the components preceded by the words "first" and "second" with respect to the expansion chamber, it is of course possible to arrange such components differently in dimensions and configurations on the opposite sides of the expansion chamber. Also, in the above applications of the apparatus, only one article is fed through the apparatus at a time, but two or more article may be fed through the apparatus simultaneously. Further, it is still possible to include in the apparatus of the present invention any combination of the particular features disclosed in the above modifications of FIGS. 3 to 6. Moreover, in the above embodiment the first and second throats 51 and 52 are formed to produce the corresponding jets, but other jet-producing means can be formed in the apparatus instead of the throat so long as the jets rush over the article passing in the first and second constricted passageways 31 and 32.

What is claimed is:

1. An apparatus for applying surface treatment on an article being fed along a pass line comprising in combination:

a tunnel adapted to be located on a portion of the pass line with its longitudinal axis aligned therewith, said tunnel being provided at its one longitudinal end with an inlet through which said article enters the tunnel and at the other longitudinal end with an outlet through which the article exits the tunnel;

an expansion chamber formed within the tunnel midway between the inlet and the outlet;

a first fluid introducing port for introducing a fluid flow into the tunnel, said first fluid introducing port being located between the inlet and the expansion;, chamber and communicated with the expansion chamber;

a supply vent for supplying a treating agent located between the first fluid introducing port and the inlet;

a first constricted passageway intercommunicating the first fluid introducing port and the expansion chamber and extending along the pass line for receiving therethrough said article;

a first throat formed between the first fluid introducing port and the end of the constricted passageway remote from the expansion chamber so as to produce a first jet of the fluid supplied from the first fluid introducing port and force it to blow into the passageway where it rushes over the article in the same direction as the article for treating the surface thereof, said first jet developing a negative pressure upstream thereof so as to draw in ambient air through the inlet over the article for providing an air seal around the article within the inlet whereby preventing the fluid from escaping outwardly through the inlet;

a second fluid introducing port for introducing a fluid flow into the tunnel, said second fluid introduction port being located between the outlet and the expansion chamber and communicated with the expansion chamber;

a second constricted passage way intercommunicating the second fluid introducing port and the expansion chamber and extending along the pass line for receiving therethrough said article;

a second throat formed between the second fluid introducing port and the end of the constricted passageway remote from the expansion chamber so as to produce a second jet of the fluid supplied from the second fluid introducing port and force it to blow into the passageway where it is blasted over the article in the opposite direction to the article passing in the passageway for treating the surface thereof, said second jet developing a negative pressure upstream thereof so as to draw in ambient air through the outlet over the article for providing an air seal around the article within the outlet whereby preventing the fluid from escaping outwardly through the outlet;

a discharge port on the side of the expansion chamber for recovering the first and second fluid flows therefrom;

said first and second throats being inclined with respect to a common axis of the first and second passageways at an angle of 15 to 60 degrees; and a spiral groove being formed within the first and second throats.

2. An apparatus for applying surface treatment on an article being fed along a pass line comprising:

a tunnel located along the pass line, said tunnel being provided with an inlet for said article at its one longitudinal end and at another longitudinal end with an outlet;

an expansion chamber formed between the inlet and outlet;

a first fluid introducing port located between the inlet and the expansion chamber and communicated with the expansion chamber;

supply vent for supplying a treating agent located between the first fluid introducing port and the inlet;

a first constricted passageway intercommunicating the first fluid introducing port and the expansion chamber;

a first throat formed between the first fluid introducing port and the end of the constricted passageway remote from the expansion chamber so as to produce a first jet of the fluid supplied from the first fluid introducing port and force it to blow into the passageway where it rushes over the article in the same direction as that of the article;

a second constricted passageway intercommunicating the second fluid introducing port and the expansion chamber;

a second throat formed between the second fluid introducing port and the end of the constricted passageway remote from the expansion chamber so as to produce a second jet of the fluid supplied from the second fluid introducing port and force it to blow into the passageway where it is blasted over the article in the opposite direction to the article;

a discharge port on the side of the expansion chamber for recovering the first and second fluid flows therefrom;

said first throat and second throat being inclined with respect to a common axis of the first and second passageways at an angle between 15 and 60 degrees; and a spiral groove being formed within the first and second throats.

3. An apparatus according to claim 2, wherein said expansion chamber is formed in the interior wall thereof with spiral grooves.

4. An apparatus according to claim 2, wherein the first and second constricted passageways are formed with spiral grooves respectively in the inner surfaces thereof.

5. An apparatus according to claim 2, wherein each of the first and second constricted passageways has a parabolically shaped opening at its one end portion adjacent the expansion chamber, said opening having an internal diameter larger toward the expansion chamber.

* * * * *